US007182453B2

(12) United States Patent
Nakajima

(10) Patent No.: US 7,182,453 B2
(45) Date of Patent: Feb. 27, 2007

(54) INK JET RECORDING APPARATUS AND INK JET RECORDING METHOD

(75) Inventor: Atsushi Nakajima, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 153 days.

(21) Appl. No.: 10/727,904

(22) Filed: Dec. 4, 2003

(65) Prior Publication Data

US 2004/0141040 A1 Jul. 22, 2004

(30) Foreign Application Priority Data

Dec. 13, 2002 (JP) ..... 2002-361849

(51) Int. Cl.
*B41J 2/01* (2006.01)

(52) U.S. Cl. ..... 347/102; 347/103; 347/41; 347/43

(58) Field of Classification Search ..... 347/102, 347/41, 43, 1–2
See application file for complete search history.

(56) References Cited

U.S. PATENT DOCUMENTS 5,844,585 A * 12/1998 Kurashima et al. ..... 347/43
2003/0035037 A1* 2/2003 Mills et al. ..... 347/102

FOREIGN PATENT DOCUMENTS

| | | |
|---|---|---|
| JP | 60-119554 | 6/1985 |
| JP | 06-200204 | 7/1994 |
| JP | 2000-504778 | 4/2000 |

* cited by examiner

*Primary Examiner*—Stephen Meier
*Assistant Examiner*—Ly T. Tran
(74) *Attorney, Agent, or Firm*—Lucas & Mercanti, LLP

(57) ABSTRACT

An ink jet recording apparatus is disclosed. The apparatus has a section which forms an image by ejecting an ultraviolet radiation curable ink from an ink jet recording head onto a recording material and a section which exposes ultraviolet radiation to an ink image formed on the recording material, and the ink jet recording apparatus has a plurality of recording modes having a different image recording speed in each mode, and further an exposure intensity of ultraviolet radiation exposing to the ink is variable. An ink jet recording method is also disclosed.

9 Claims, 3 Drawing Sheets

| | INK OF FIRST PASS | INK OF SECOND PASS | INK OF THIRD PASS | INK OF FOURTH PASS |
|---|---|---|---|---|
| EXPOSURE FREQUENCY BEFORE INK DEPOSITION | ONLY SUBSTRATE 0 | 0, 2 TIMES | 0 - 4 TIMES | 0 - 6 TIMES |
| EXPOSURE FREQUENCY AFTER INK DEPOSITION | 1 TIME | 1 - 3 TIMES | 1 - 5 TIMES | 1 - 7 TIMES |

FIG. 3 ( a )
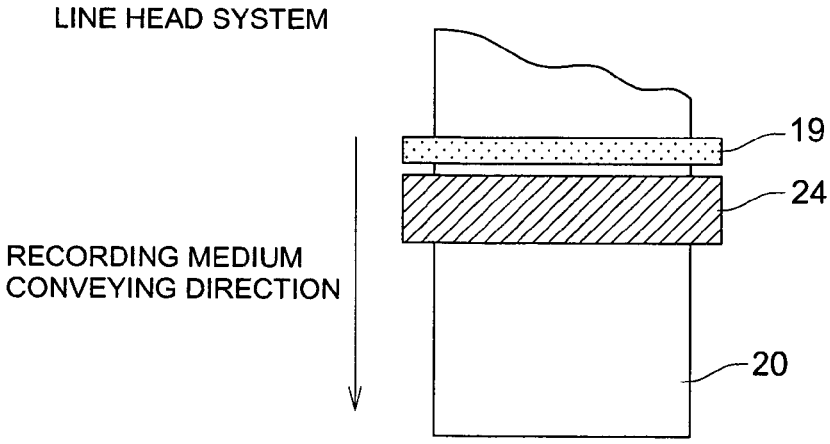
FIG. 3 ( b )
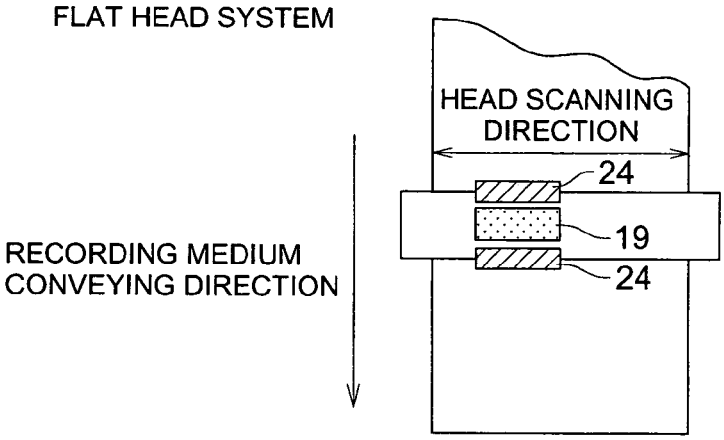
FIG. 3 ( c )
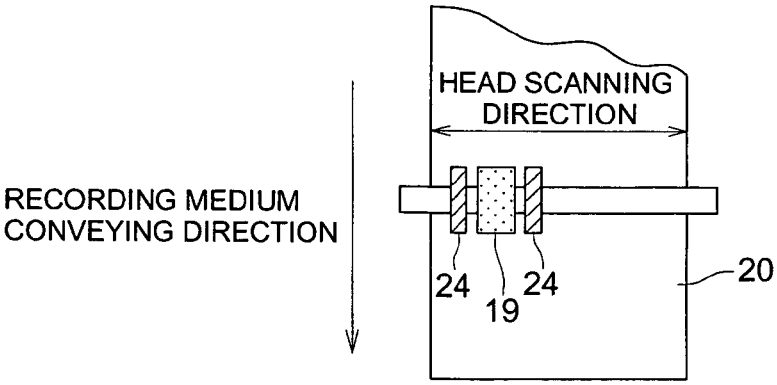

INK JET RECORDING APPARATUS AND INK JET RECORDING METHOD

BACKGROUND OF THE INVENTION

The present invention relates to an ink jet recording apparatus and an ink jet recording method in which images are formed by ejecting, from an ink jet recording head, an ultraviolet radiation curable ink which is capable of undergoing reaction and being cured by exposure to ultraviolet radiation and subsequently fixed, and more specifically to an ink jet recording apparatus as well as an ink jet recording method in which, even though images are formed employing a plurality of recording modes which differ in image recording rate, high quality images are always formed.

In recent years, section to form color images on various recording materials have been markedly diversified, and images are produced employing diversified section such as conventional silver salt photography which has been widely employed to, for example, color paper, as well as electrophotographic systems and ink jet recording systems.

Particularly, since ink jet recording systems are capable of simply preparing images at low cost, this is applied to various printing fields such as photography, various kinds of printing, or specialized printing such as marking or color filters. Specifically, by employing combinations of an ink jet recording system apparatus (an ink jet printer) which ejects and controls minute dots, an ink which exhibits improved color reproduction range, durability, and ejection adaptability, and special paper which exhibits markedly improved ink absorbability, color forming properties of colorants, and surface gloss, it is possible to achieve image quality comparable to silver salt photography. Current improvement of image quality obtained by the ink jet recording system is finally achieved by the integration of the ink jet printer, and ink and special paper employed in the aforesaid ink jet printers.

However, in ink jet printers which require special paper, recording media are limited. As a result, cost of recording media increases and the application field of the ink jet printers is limited. Consequently, many trials have been conducted in which recording is achieved on recording media different from special paper sheets, employing an ink jet system. Specifically, included are a phase variation ink jet system employing a wax ink which is solid at room temperature, a solvent based ink jet system which uses ink comprised of quick drying organic solvents as a main component, and a UV ink jet system in which after recording, crosslinking is achieved employing ultraviolet (UV) radiation.

Of these, in recent years, UV ink jet systems have received specific attention due to relatively low generation of unpleasant odor compared to solvent based ink jet systems, rapid drying, and capability of recording on non-ink absorptive recording media. For example, Japanese Patent Publication No. 5-54667, and Japanese Patent Publication Open to Public Inspection Nos. 6-200204 and 2000-504778 disclose ultraviolet radiation curable ink jet inks.

Ultraviolet radiation curable inks are divided mainly into solvent-free ultraviolet radiation curable inks comprising minimal non-curable solvents and water based ultraviolet radiation curable inks in which photopolymerizable compounds are dissolved or dispersed into water based media.

Since it is possible to cure the solvent-free ultraviolet radiation curable ink only by exposure to ultraviolet radiation and then to dry the resultant image, it exhibits advantages such as suitability for high speed image recording and minimal generation of hazardous substances such as VOC (volatile organic compounds). As a result, it has been put into practical use. However, the solvent-free ultraviolet radiation curable ink results in no volume contraction during curing. As a result, deposited ink droplets result in tactile roughness and also a feel of quality different from common printed matter.

However, it is possible to minimize the aforesaid tactile roughness in such a manner that exposure to ultraviolet radiation is delayed to a degree in which bleeding results in minimal problems so that ink droplets result in leveling. Simultaneously, it is possible to improve color reproduction. Namely, in order to control the characteristics of formed images, a method is effective in which duration from ink ejection to exposure to ultraviolet radiation and radiation intensity are controlled to optimal conditions.

Disclosed as one of the aforesaid methods (for example, refer to Patent Document 1 as well as Non-Patent Document 1) is a method in which wettability of ink which is further deposited on the former ink is improved by limiting the energy of exposed ultraviolet radiation of the primary exposure to 5 percent.

However, according to investigations performed by the inventors of the present invention, when image recording is carried out employing an ink jet printer having a plurality of recording modes which differ in image recording rate, no desired results are obtained by only simply controlling the initial exposure energy.

Specific descriptions will now be made.

Referring to FIG. 1, an example is described in which images are formed employing a serial printing system while ultraviolet radiation sources for exposure are installed at both ends of a carriage fitted with an ink jet recording head.

As shown in FIG. 1, two-way printing is carried out employing the serial printing system. When an ink jet image is formed employing 4 passes in total (two reciprocating motions), the cases described below occur as the state of the position on which ink is deposited onto a recording material at the fourth final pass.

1) The surface of the recording material remains as it is and an ink surface on which no printing is carried out
2) An image formed by other ink ejected in the same scanning and an ink surface which is not yet exposed to ultraviolet radiation
3) An ink surface comprising an image which has been twice exposed to ultraviolet radiation
4) An ink surface comprising an image which has been exposed to ultraviolet radiation four times
5) An ink surface comprising an image which has been exposed to ultraviolet radiation six times In addition, various images under different situations exist in the state in which each cases 2)–5) overlap. Further, in images which have been subjected to the fourth pass printing and exposure to ultraviolet radiation employing the aforesaid method, images are formed while mixed with ink printing portions which have been subjected to various frequency of exposure to ultraviolet radiation such as 1–7.

In the foregoing, description was made referring to the example in which ink jet images are formed employing two-way printing under 4 passes (two reciprocating motions). However, in practice, desired resolution, the printing method (two-way or one-way printing), or the frequency of passes differs. As a result, the number of cases corresponding to each differs. For example, in one-way printing, when images are formed under interleave of 3 and 12 passes, various ink images which have been exposed to ultraviolet radiation of the frequency of 0–19 simultaneously exist on the recording material at ink deposition.

Further, when taking into account combinations of a plurality of colors, the number of the resulting cases markedly increases. As a result, it is impossible to control each of them to be optimal conditions.

Generally, the diameter of deposited ink droplets depends on either recording materials used as a substrate or the history of exposure of ultraviolet radiation to ink. In conventionally disclosed case examples, no description is made with regard to how optimal conditions are set employing what type of ink having any history of exposure to ultraviolet radiation is used as a standard.

(Patent Document 1)

Specification of U.S. Pat. No. 6,457,823

(Non-Patent Document 1)

Industrial Application of UV-Curing Jet Ink, Niegel Caiger, DDP2001 Final Program and Proceedings, 161

SUMMARY OF THE INVENTION

The present invention is intended to provide an ink jet recording apparatus as well as an ink jet recording method which is capable of stably producing images which exhibit excellent bleeding resistance, a feel of glossiness, and color reproduction, even though the aforesaid images are formed employing a plurality of recording modes which differ in image recording speed.

The present invention, and embodiments thereof, will now be described.

1. An ink jet recording apparatus which comprises a section which forms an ink image by ejecting an ultraviolet radiation curable ink from an ink jet recording head onto a recording material and a section which exposes ultraviolet radiation to the ink image formed on the recording material, wherein the ink jet recording apparatus has a plurality of recording modes each having a different image recording speed in each mode, and an exposure intensity of ultraviolet radiation exposing to the ink is variable.

2. The ink jet recording apparatus, described in 1. above, wherein the image recording speed is varied by (a) varying the relative speed of an ink jet nozzle with respect to the recording material, (b) varying recording resolution, or (c) varying pass frequency of an interleave system.

3. The ink jet recording apparatus, described in 1. or 2. above, wherein the exposure intensity of ultraviolet radiation is varied by varying the exposure area of ultraviolet radiation or varying an illumination intensity of ultraviolet radiation.

4. The ink jet recording apparatus, described in any one of 1., 2., or 3. above, which further comprises a control section which maintains a nearly constant energy amount per unit area of ultraviolet radiation exposing to the recording material, independent of the image recording speed.

5. The ink jet recording apparatus described in any one of 1., 2., or 4. above, in which an exposure intensity of ultraviolet radiation exposing to the ink is varied corresponding to the image recording speed.

6. An ink jet recording method which forms an ink image by ejecting an ultraviolet radiation curable ink from an ink jet recording head onto a recording material and subsequently exposing ultraviolet radiation to the ink image, wherein the ink jet recording method comprises a plurality of recording modes having a different image recording speed in each mode and an exposure intensity of ultraviolet radiation exposing to the ink is variable.

7. The ink jet recording method, described in 6. above, wherein the image recording speed is varied by (a) varying the relative speed of an ink jet nozzle with respect to the recording material, (b) varying recording resolution, or (c) varying pass frequency of an interleave system.

8. The ink jet recording method, described in 6. or 7. above, wherein the exposure intensity of ultraviolet radiation is varied by varying the exposure area of ultraviolet radiation or varying the illumination intensity of ultraviolet radiation.

9. The ink jet recording method, described in any one of 5. through 7. above, which comprises a control section which maintains a nearly constant energy amount per unit area of ultraviolet radiation exposed to a recording material, independent of the image recording speed.

BRIEF DESCRIPTION OF THE DRAWINGS

FIG. 3 is a schematic view showing one example of an ink jet printing system capable of being employed in the present invention.

DETAILED DESCRIPTION OF THE INVENTION

Figure 1:
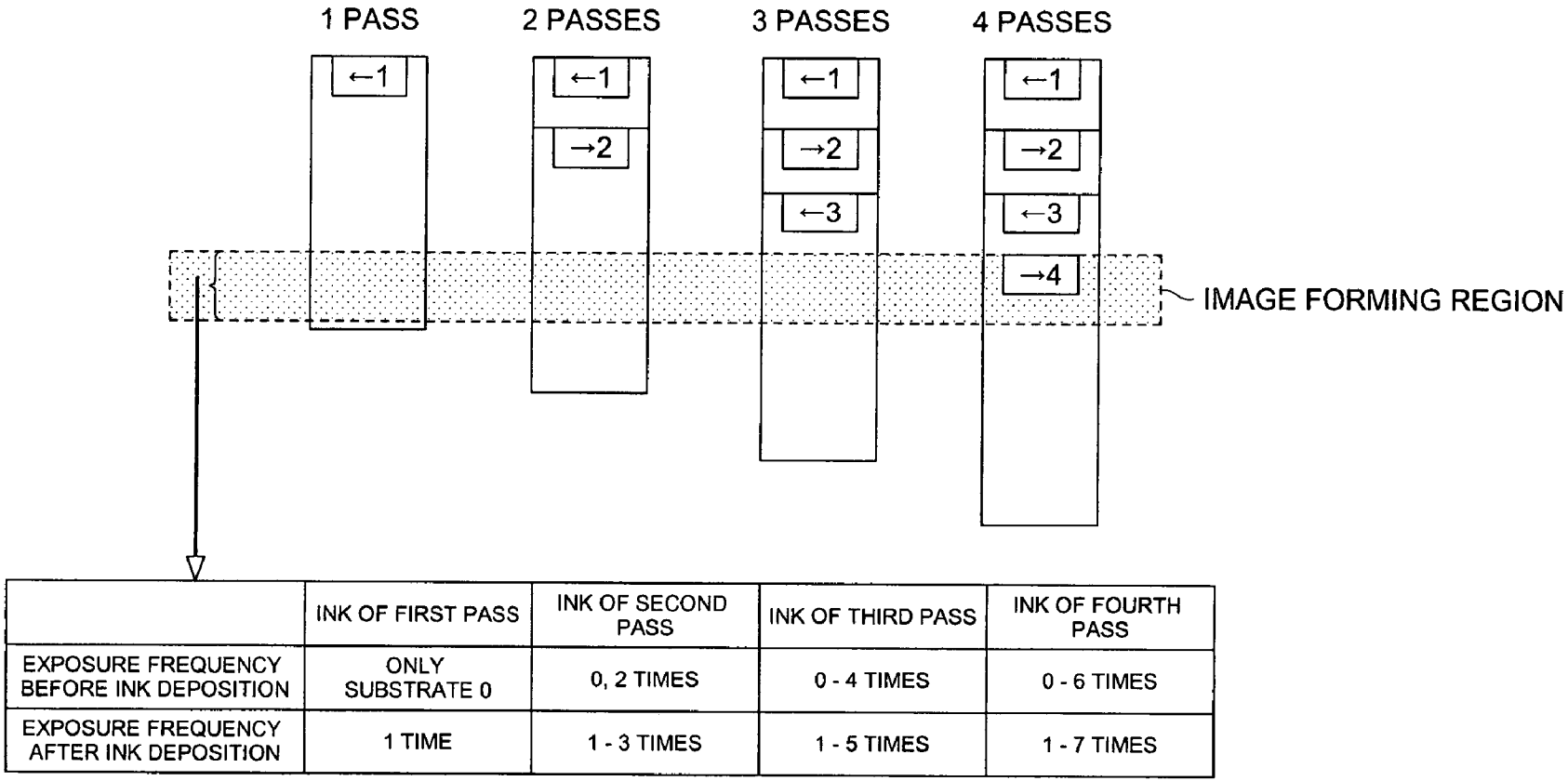
FIG. 1 is a view showing one example of the situation in which a plurality of two-way printing passes is carried out employing a serial printing system.

The inventors of the present invention were able to realize an ink jet recording apparatus as well as an ink jet recording method based on the following discoveries. Of ink jet recording apparatuses which comprised a section which formed ink jet images by ejecting an ultraviolet radiation curable ink from an ink jet recording head onto a recording material, as well as a section which exposed ultraviolet radiation to ink images formed on the aforesaid recording material, an ink jet recording apparatus was used comprised a plurality of recording modes which differed in image recording speed and was capable of varying the intensity of ultraviolet radiation exposure to the aforesaid ink. Even when images were formed employing a plurality of recording modes which differed in image recording speed by optionally controlling the exposure intensity of ultraviolet radiation, it was possible to stably form images which exhibited excellent bleeding resistance, a feel of glossiness, and color reproduction.

It is preferable that image recording speed is set employing a section which varies the relative speed of the ink jet nozzle with respect to the recording material, a section which varies recording resolution, or a section which varies pass frequency employing an interleave system. A section which controls exposure intensity of ultraviolet radiation is preferably either a section which varies the exposure range of ultraviolet radiation or a section which varies illumination intensity of ultraviolet radiation. Even when recording speed varies due to variations of mode, it is preferable that a control section is provided which maintains a nearly constant energy amount of ultraviolet radiation exposed to the unit area of recording materials.

The present invention will now be detailed.

Initially, the ink jet recording apparatus of the present invention will be described appropriately referring to the drawings. The recording apparatus shown in drawings is one embodiment to describe the present invention.

In one of the embodiments of this invention intensity of ultraviolet radiation exposure to ink varies based on image recording speed.

When either a high speed recording mode or a character recording mode is selected and a head scans at high speed to carry out recording, high intensity ultraviolet radiation is employed for exposure. On the other hand, when either a picture mode or a fine recording mode is selected and images are recorded by ejecting small dot forming ink under low speed scanning, low intensity ultraviolet radiation is employed for exposure. As noted above, even though the recording speed varies due to changes of recording mode, exposure amount per unit area of recording material is controlled to be nearly constant.

Up to now, even when recording was carried out under low speed scanning, the exposure amount was not varied and an exposure amount which was required for high speed recording was employed. Consequently, when recording was carried out under low speed scanning, an excessive amount of ultraviolet radiation resulted, whereby images were occasionally prepared which clearly exhibited roughness due to ink particles or resulted in insufficient glossiness.

Figure 2:
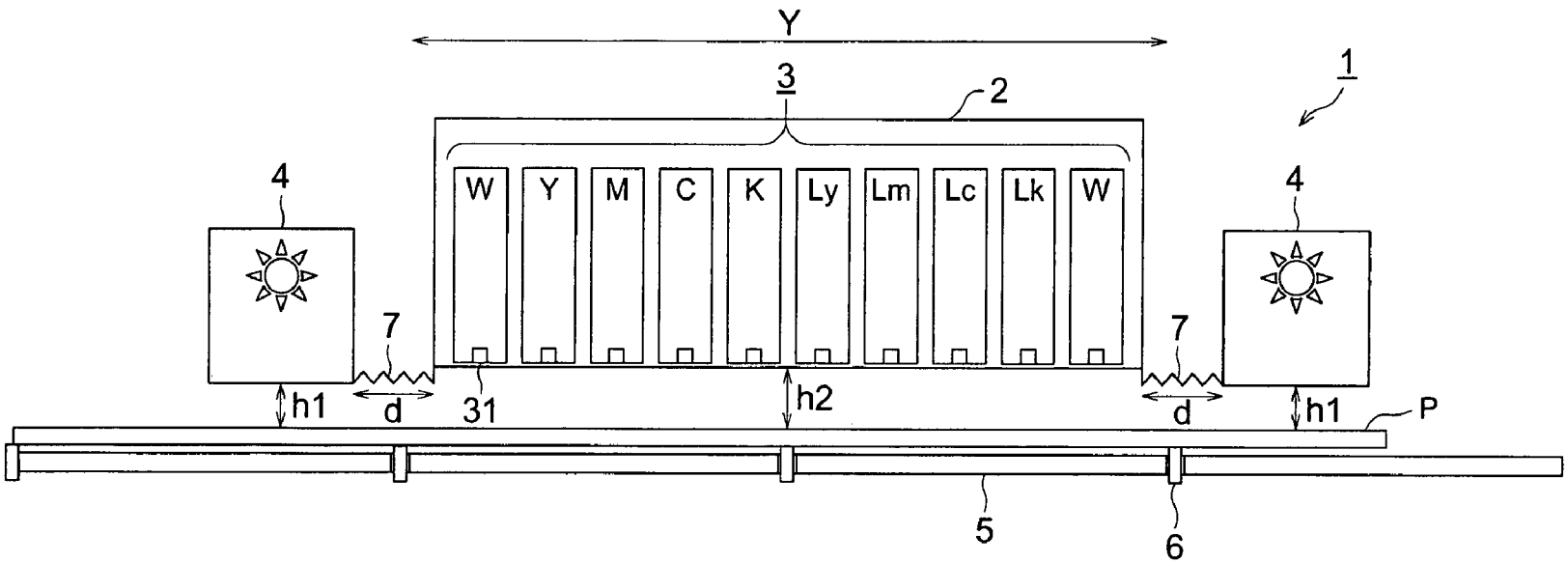
FIG. 2 is a front view showing one example of the constitution of a major section employed in a serial printing system in the ink jet printing apparatus of the present invention.

FIG. 2 is a front view showing a major section of a serial printing system of the ink jet recording apparatus of the present invention. Recording apparatus 1 comprises head carriage 2, recording head 3, exposure section 4, and platen section 5. In aforesaid recording apparatus 1, platen section 5 is arranged under recording material P. Platen section 5 functions as an ultraviolet radiation absorption medium and absorbs excessive ultraviolet radiation. As a result, it is possible to very stably reproduce highly detailed images.

Recording material P is guided by guide members 6 and moves backward from the front in FIG. 2 by the operation of a conveying means (not shown). A head scanning means (not shown) enables recording head 3 to achieve reciprocating motion in the Y direction in FIG. 2 so that aforesaid recording head held 3 by head carriage 2 is subjected to scanning.

Head carriage 2 is arranged above recording material P and houses a plurality of recording heads 3, described below, corresponding to the number of colors employed for image printing on recording material P while arranging ejection outlets on the lower edge. Head carriage 2 is arranged with respect to the main body of recording apparatus 1 in such a manner that it allows reciprocating motion in the Y direction in FIG. 2, and performs reciprocating motion in the Y direction in FIG. 2 while driven by a head scanning means.

In FIG. 2, head carriage 2 houses white (W), yellow (Y), magenta (M), cyan (C), black (K), light yellow (Ly), light magenta (Lm), light cyan (Lc), light black (Lk), and white (W) recording heads 3. However, in practice, the number of colors housed in recording head 3 can be suitably determined.

Recording head 3 ejects onto recording material P actinic radiation curable inks (for example, ultraviolet radiation curable inks) from ejection outlets by operation of a plurality of ejection means 3 arranged in the interior.

The ultraviolet radiation curable ink ejected from recording head 3 incorporates colorants, polymerizable monomers, and initiators and exhibits properties in which, when exposed to ultraviolet radiation, curing occurs through crosslinking and polymerization reaction of monomers while employing the initiators as a catalyst.

Recording head 3 ejects the ultraviolet curable ink in the form of ink droplets and deposits them onto the definite region (the deposit allowed region) on recording material P while it scans from one edge of recording material P to the other while driven by a scanning means.

Suitable frequency of the aforesaid scanning is carried out. After ejecting the ultraviolet curable ink within the allowable deposition area in one region, recording material P is suitably shifted from the front to rear in FIG. 2. While again carrying out scanning employing the scanning means, the ultraviolet curable ink is ejected onto the next allowable deposition region adjacent in the backward direction in FIG. 2, employing recording head 3.

By repeating the aforesaid operation and ejecting the ultraviolet radiation curable inks from recording head 3 while synchronizing the head scanning means with the conveying means, images which are comprised of an assembly of ultraviolet radiation curable ink droplets are formed.

Exposure means 4 is comprised of an ultraviolet radiation lamp which emits ultraviolet radiation of specified wavelengths at stable exposure energy, as well as filters which transmit ultraviolet radiation of the specified wavelengths. Herein, as ultraviolet radiation lamps, usable are mercury lamps, metal halide lamps, excimer lasers, ultraviolet radiation lasers, cold-cathode tubes, black-lights, and LEDs (light emitting diodes). Of these, preferred are flat metal halide lamps, cold-cathode tubes, mercury lamps, or black-lights. Particularly preferred are those of which exposure intensity can be suitably regulated.

Exposure means 4 is securely fixed to head carriage 2. Ultraviolet radiation is exposed to ink which is ejected from the recording head while scanning. Consequently, exposure means 4 is provided with the shape and size necessary for exposing ultraviolet radiation to the ejected ink while scanning. An exposure means may be installed on one side of head carriage 2. When two-way scanning is carried out, it is preferable to install the aforesaid exposure means on both sides of head carriage 2.

In FIG. 2, exposure means 4 are securely fixed on both sides of carriage 2 being nearly parallel to recording material P.

It is not preferable that the recording head is subjected to exposure of ultraviolet radiation. Consequently, it is effective to shield the entire recording head 3 from radiation, in addition to make distance h2 between ink ejection section 31 of recording head 3 and recording material P greater than distance h1 between exposure means 4 and recording material P, and to increase distance d between recording head 3 and exposure means 4. Further, it is more preferable that bellows structures 7 are used between recording head 3 and exposure means 4.

Herein, it is possible to appropriately change the wavelength of ultraviolet radiation emitted from exposure means 4 by replacing the ultraviolet radiation lamp or filters installed in exposure means 4.

As noted above, in FIG. 2, description of the embodiment was made while using the serial printing system as an example. Other than this, it is possible to use the ink jet recording apparatus of any ink jet printing system, as shown in FIGS. 3(*a*), 3(*b*), and 3(*c*).

FIG. 3(*a*) shows a method (being a line head system) in which recording head 19 is arranged in the lateral direction of recording material 20, and while a recording medium is being conveyed, printing and exposure to actinic radiation by the use of exposure means 24 are carried out. FIG. 3(*b*) shows a method (being a flat head system) in which recording head 19, while moving in the secondary scanning direction, carries out printing and further actinic radiation is exposed employing exposure means 24. FIG. 3(*c*) shows a method (being a serial printing system) in which recording head 24, which is described above, carries out printing while scanning in the lateral direction on a recording material and further actinic radiation is exposed employing exposure means 24 arranged at both ends. It is possible to use any of these systems.

In the present invention, after depositing all inks as desired onto recording materials, secondary exposure may be carried out to promote a reaction.

In the ink jet recording apparatus or the ink jet recording method of the present invention, a plurality of recording modes which differ in image recording speed is provided and the intensity of ultraviolet radiation exposed to ink is varied corresponding to each of the recording modes.

Generally, the exposure energy amount of ultraviolet radiation per unit time or unit area varies corresponding to variation of the image recording speed. However, in the present invention, it is possible to stably form images by controlling the exposure energy amount of ultraviolet radiation per unit time or unit area corresponding to image recording speed. As a result, it is possible to stably form images which exhibit excellent bleeding resistance, a feel of glossiness and color reproduction.

Further, in the ink jet recording apparatus or the ink jet recording method, it is preferable that image recording speed is set employing a means which varies the relative speed of the ink jet nozzle with respect to recording materials, a means which varies recording resolution, or a means which varies pass frequency of the interleave system. In the present invention, it is possible to carry out stable image formation by varying the relative speed of the ink head nozzles arranged in the recording head with respect to the recording material, corresponding to the contents of the recorded images.

It is possible to apply the above-mentioned method to any of the aforesaid systems such as a serial printer, or a line printer, and a drum system.

Further, except for one pass image recording in a one-way direction, a method which varies pass frequency of the interleave system may be applicable to a serial printer, a line printer, or a drum system. In the case of a serial printing system, it is possible to vary the desired image recording speed by appropriately regulating one-way direction/two-way direction, resolution, the number of interleaves, and carriage speed. It is possible to express the unit of the image recording speed as the maximum printable area per unit time ($cm^2$/second).

The exposure intensity of ultraviolet radiation is preferably varied by varying either the exposure range or the illumination intensity of ultraviolet radiation.

It is possible to express the exposure intensity of ultraviolet radiation as mW, which expresses effective ultraviolet radiation energy which can expose recording materials over unit time (one second).

It is possible to set the desired conditions for exposure energy of ultraviolet radiation by suitably combining methods such as variation of exposure range, variation of the number of turned-on radiation sources emitting ultraviolet radiation or variation of electric power supplied to the radiation sources.

It is preferable that even though image recording speed varies due to the selected recording mode, a control means can be provided which controls the energy amount of ultraviolet radiation exposed to unit area of recording materials to a nearly constant level.

Generally, as the exposure frequency of ultraviolet radiation increases after ink deposition, wettability of ink, which is deposited on the previous ink, decreases. In the serial printing system and the other systems, as the number of passes increases, difference in exposure frequency of ultraviolet radiation increases. As a result, the area in which ink deposited on a previously formed image is subjected to sufficient leveling is very different from the area in which curing is carried out prior to leveling, resulting in roughness.

In the present invention, it is possible to equalize image quality by allowing the exposure amount of ultraviolet radiation in the area of the maximum exposure frequency of ultraviolet radiation to be nearly constant, irrespective of recording speed. In order to allow the exposure amount of ultraviolet radiation to be constant, standards such as surface energy after curing, surface tension of liquid ink composition, or advance contact angle may be employed. However, the aforesaid standards vary depending on the targeted leveling properties. When, of a plurality of image recording modes, the amount of exposure energy, which is finally provided by one of the image recording modes employed as a standard is assumed to be 100 per unit area, the amount of exposure energy provided by other modes is preferably 50–250, and is more preferably 70–150. When the amount of exposure energy of ultraviolet radiation is at most 50, leveling properties are improved, but problems still occur in which bleeding between inks occurs to distort images whereby resolving power is degraded. On the other hand, when exposure energy is at least 250, leveling of ink deposited on the previously formed image becomes insufficient. As a result, it is not preferable because tactile roughness and degradation of the raised feel, as well as degradation of glossiness, colorfulness, and color reproduction occur.

The ultraviolet radiation curable ink according to the present invention will now be detailed.

In the ink jet recording method of the present invention, after forming or printing images by ejecting ink compositions onto recording materials employing an ink jet recording apparatus, a printed ink is cured by exposure to actinic radiation such as ultraviolet radiation.

The polymerizable compounds used in the invention include a radical polymerizable compound and a cation polymerizable compound. Examples of the radical polymerizable compound include those disclosed in Japanese Patent O.P.I. Publication Nos. 7-159983, 8-224982, and 10-863 and Japanese Patent Publication No. 7-31399.

The radical polymerizable compound is an ethylenically unsaturated compound capable of being polymerized by a radical, and is any compound, as long as it has at least one ethylenically unsaturated double bond in the molecule. The radically polymerizable compound may have any structure in the form of monomer, oligomer or polymer. The radical polymerizable compounds can be used singly or as a mixture of two or more kinds thereof at any content ratio, according to the objects of the usage.

The ethylenically unsaturated compounds, capable of being polymerized by a radical, include an unsaturated carboxylic acid such as acrylic acid, methacrylic acid, itaconic acid, crotonic acid, isocrotonic acid, or maleic acid or its salt; ester; urethane; amide or anhydride; acrylonitrile; styrene; unsaturated polyesters; unsaturated polyethers; unsaturated polyamides; and unsaturated polyurethanes. Examples thereof include an acrylic acid derivative such as 2-ethylhexyl acrylate, 2-hydroxyethyl acrylate, butoxyethyl acrylate, carbitol acrylate, cyclohexyl acrylate, tetrahydrofurfuryl acrylate, benzyl acrylate, bis(4-acryloxypolyethoxyphenyl)propane, neopentyl glycol diacrylate, 1,6-hexanediol diacrylate, ethylene glycol diacrylate, diethylene glycol diacrylate, triethylene glycol diacrylate, tetraethylene glycol diacrylate, polyethylene glycol diacrylate, polypropylene glycol diacrylate, pentaerythritol triacrylate, pentaerythritol tetraacrylate, dipentaerythritol tetraacrylate, trimethylolpropane triacrylate, tetramethylolmethane tetraacrylate, oligo ester acrylate, N-methylol acryl amide, diacetone acryl amide, or epoxy acrylate; a methacrylic acid derivative such as methyl methacrylate, n-butyl methacrylate, 2-ethylhexyl methacrylate, lauryl methacrylate, allyl methacrylate, glycidyl methacrylate, benzyl methacrylate, dimethylaminomethyl methacrylate, 1,6-hexanediol dimethacrylate, ethylene glycol dimethacrylate, triethylene glycol dimethacrylate, polyethylene glycol dimethacrylate, polypropylene glycol dimethacrylate, trimethylolethane trimethacrylate, trimethylolpropane trimethacrylate, or 2,2-bis (4-methacryloxy-polyethoxyphenyl)propane; an allyl compound such as alltl glycidyl ether, diallyl phthalate or triallyl trimellitate; and radical polymerizable or crosslinkable monomers, oligomers or polymers described in S. Yamashita et al., "Crosslinking agent Handbook", Taisei Co., Ltd. (1981), K. Kato et al., "UV, EB Hardenable Handbook (Materials)", Kobunshi Kankokai (1985), Radotek Kenkyukai, "UV, EB Hardening Technology, Application and Market", pp. 79, CMC Co. Ltd. (1989), and E. Takiyama, "Polyester Resin Handbook", Nikkan Kyogyo Shinbunsha (1988).

The content of the radical polymerizable compound in ink is preferably from 1 to 97% by weight, and more preferably from 30 to 95% by weight.

Various cationic polymerizable compounds can be used in combination as the cationic polymerizable monomer. Examples of such the monomer include epoxy compounds and vinyl ether compounds, and oxetane compounds exemplified in JP O.P.I. Nos. 6-9714, 2001-31892, 2001-40068, 2001-55507, 2001-310938, 2001-310937 and 2001-220526.

Preferred example of the aromatic epoxide is a di- or poly-glycidyl ether produced by reaction of a poly-valent phenol having at least one aromatic nucleus or an alkylene oxide adduct thereof with epichlorohydrin, such as a di- or poly-glycidyl ether of bisphenol A or an alkylene oxide adduct thereof, a di- or poly-glycidyl ether of hydrogenised bisphenol A or an alkylene oxide adduct thereof and a novolak type epoxy resin. In the above, ethylene oxide and propylene oxide are usable as the alkylene oxide.

The aliphatic cyclic epoxide is obtained by epoxidizing a compound having at least one cycloalkane group such as cyclohexane ring and a cyclopentene ring by a suitable oxidant such as hydrogen peroxide and a peracid. A compound containing cyclohexane oxide or cyclopentene oxide is preferable.

An aliphatic poly-valent alcohol and a di- or poly-glycidyl ether of an ethylene oxide adduct thereof is cited as the preferable aliphatic epoxide. Typical examples of such the compound include diglycidyl ether of an alkylene glycol such as diglycidyl ether of ethylene glycol, diglycidyl ether of propylene glycol and diglycidyl ether of 1,6-hexanediol; a poly-glycidyl ether of poly-valent alcohol such as a di- or tri-glycidyl ether of glycerol or an alkylene oxide adduct thereof and a diglycidyl ether of propylene glycol such as a glycidyl ether of polypropylene glycol or an alkylene oxide adduct thereof. Examples of the alkylene oxide in the above-mentioned include ethylene oxide and propylene oxide.

Among the foregoing epoxides, the aromatic epoxide and the aliphatic cyclic epoxide are preferred according to the consideration on the rapid hardening property, and the aliphatic cyclic epoxide is particularly preferred. In the invention, two or more kinds of epoxide may be used in a suitable combination even though a kind of the epoxide may be singly used.

Examples of the vinyl ether compound include a di- or tri-vinyl ether compound such as ethylene glycol di-vinyl ether, diethylene glycol di-vinyl ether, propylene glycol di-vinyl ether, dipropylene glycol di-vinyl ether, butanediol glycol di-vinyl ether, hexanediol glycol di-vinyl ether, cyclohexanedimethanol glycol di-vinyl ether and trimethylpropane tri-vinyl ether; and a mono-vinyl ether compound such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol mono-vinyl ether, n-propyl vinyl ether, isopropyl vinyl ether, isopropenyl ether-o-propylene carbonate, dodecyl vinyl ether, diethylene glycol mono-vinyl ether and octadecyl vinyl ether.

Among the vinyl ether compounds, the di- and tri-vinyl ether compounds are preferred according to consideration on the hardening ability, the contacting ability and the surface hardness; and the di-vinyl ether is particularly preferred. In the invention, two or more kinds of the foregoing vinyl ether compound may be used in a suitable combination even though a kind of the vinyl ether may be singly used.

It is preferable to incorporate at least one of oxetane compounds in the ink to inhibit shrinkage of the recording material during hardening of the ink.

The oxetane compound is a compound having an oxetane ring. Any known oxetane compounds such as those disclosed in JP O.P.I. Nos. 2001-220526 and 2001-310937 are usable.

When a compound having five or more oxetane rings is used, the handling of the ink is made difficult since the viscosity of the ink is become too high and the adhesiveness of the hardened material is made insufficient since the glass transition point of the ink is become too high. Accordingly, a compound having from 1 to 4 oxetane rings is preferred.

An example of the compound having one oxetane ring includes a compound represented by the following Formula 1.

An example of the compound having one oxetane ring includes a compound represented by the following Formula 1.

Formula 1

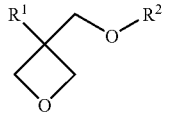

In Formula 1, $R^1$ is a hydrogen atom, an alkyl group having from 1 to 6 carbon atoms such as a methyl group, an ethyl group, a propyl group and a butyl group; a fluoroalkyl group, an allyl group, an aryl group, a furyl group or a thienyl group each having from 1 to 6 carbon atoms,. $R^2$ is an alkyl group having from 1 to 6 carbon atoms such as a methyl group, an ethyl group, a propyl group and a butyl group; an alkenyl group having from 2 to 6 carbon atoms such as a 1-propenyl group, a 2-propenyl group, a 2-methyl-1-propenyl group, 2-methyl-2-propenyl group, a 1-butenyl group, a 2-butenyl group and 3-butenyl group; a group having an aromatic ring such as a phenyl group, a benzyl group, a fluorobenzyl group, a methoxybenzyl group and phenoxyethyl group; an alkylcarbonyl group having from 2 to 6 carbon atoms such as an ethylcarbonyl group, a propylcarbonyl group and a butyl carbonyl group; an alkoxycarbonyl group having from 2 to 6 carbon atoms such as an ethoxycarbonyl group, a propoxycarbonyl group, and butoxycarbonyl group; or an N-alkylcarbamoyl group having from 2 to 6 carbon atoms such as an ethylcarbamoyl group, a propylcarbamoyl group, a butylcarbamoyl group and a pentylcarbamoyl group. In the invention, a compound having one oxetane group is preferably used since the composition containing such the compound is superior in the adhesiveness and handling suitability since the composition has a low viscosity.

Examples of the compound having two oxetane rings include ones represented by the following Formula 2.

Formula 2

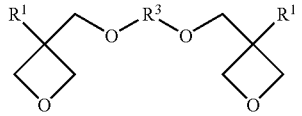

In Formula 2, $R^1$ is synonymous with $R^1$ in Formula 1; and $R^3$ is a linear- or branched-alkylene group such as an ethylene group, a propylene group and a butylenes group; a linear- or branched-poly(alkyleneoxy) group such as a poly (ethyleneoxy) group and a poly(propyleneoxy) group; a linear- or branched-unsaturated carbon hydride group such as a propenylene group, a methylpropenylene group and a butenylene group; a carbonyl group or an alkylene group containing a carbonyl group; an alkylene group or an alkylene group containing a carboxyl group; or an alkylene group containing a carbamoyl group.

As the group represented by $R^3$, a poly-valent group selected from the group represented by the following Formulas 3, 4 or 5 may be cited.

Formula 3

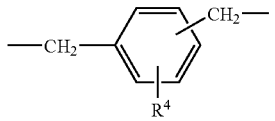

In Formula 3, $R^4$ is a hydrogen atom, an alkyl group having from 1 to 4 carbon atoms such as a methyl group, an ethyl group, a propyl group, and butyl group; an alkoxyl group having from 1 to 4 carbon atoms such as a methoxy group, an ethoxy group, a propoxy group; a halogen atom such as a chlorine atom, a bromine atom; a nitro group; a cyano group; a mercapto group; a lower alkylcarboxyl group; a carboxyl group; or a carbamoyl group.

Formula 4

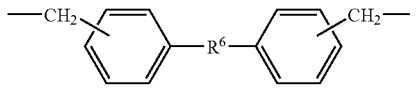

In Formula 4, $R^5$ is an oxygen atom, a sulfur atom, a methylene group, an —NH— group, an $—SO_2$ group, a $=C(CF_3)_2$ group or a $=C(CH_3)_2$ group.

Formula 5

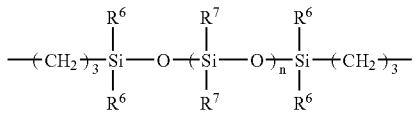

In Formula 5, $R^6$ is an alkyl group having from 1 to 4 carbon atoms such as a methyl group, an ethyl group, a propyl group and a butyl group; or an aryl group. n is an integer from 0 to 2000. $R^7$ is an alkyl group having from 1 to 4 carbon atoms such as a methyl group, an ethyl group, a propyl group and a butyl group; or an aryl group. As $R^7$, a group represented by the following Formula 6 may also be applicable.

Formula 6

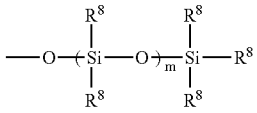

In Formula 6, $R^8$ is an alkyl group having from 1 to 4 carbon atoms such as a methyl group, an ethyl group, a propyl group and a butyl group; or an aryl group. m is an integer from 0 to 100.

Concrete examples of the compound having two oxetane rings are as follows.

Exemplified compound 1

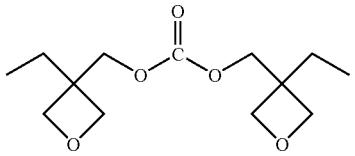

Exemplified compound 2

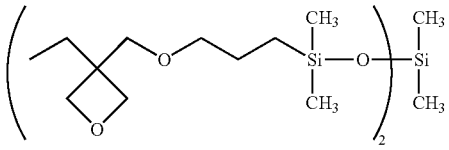

Exemplified compound 1 is a compound represented by Formula 2 in which $R^1$ is an ethyl group and $R^3$ is a carboxyl group. Exemplified compound 2 is a compound represented by Formula 2 in which $R^1$ is an ethyl group and $R^5$ is a group represented by Formula 5. In Formula 5, $R^6$ and $R^7$ are each a methyl group; and n is 1.

Preferable example of the compound having two oxetane rings other than the above-mentioned is a compound represented by the following Formula 7. In Formula 7, $R^1$ is synonymous with $R^1$ in Formula 1.

Formula 7

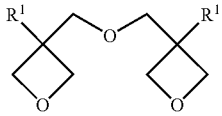

Examples of the compound having 3 to 4 oxetane rings include compounds represented by the following Formula 8.

Formula 8

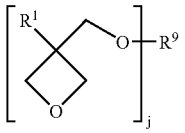

In Formula 8, $R^1$ is synonymous with $R^1$ in Formula 1. $R^9$ is, for example, a branched-alkylene group having from 1 to 12 carbon atoms such as that represented by the following A, B, C or D, or a branched polysiloxyl group represented by the following E. j is an integer of 3 or 4.

A

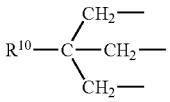

B

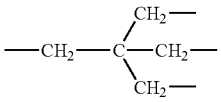

C

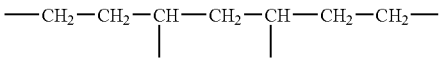

D

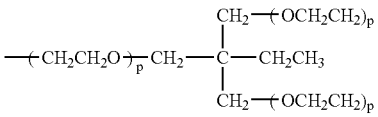

E

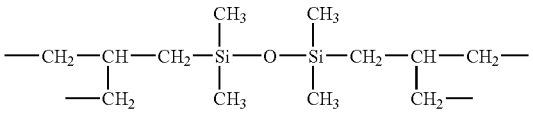

In the above A, $R^{10}$ is a lower alkyl group such as a methyl group, an ethyl group or a propyl group. In the above D, p is an integer of from 1 to 10.

An example of the compound having three to four oxetane rings is Exemplified compound 3.

Exemplified compound 3

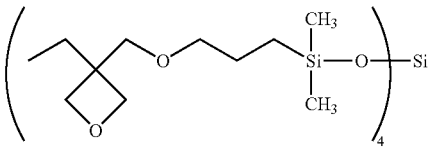

Moreover, examples of the oxetane compound having from 1 to 4 oxetane rings include compounds represented by the following Formula 9.

Formula 9

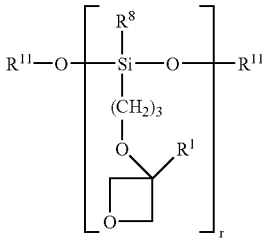

In Formula 9, $R^8$ is synonymous with $R^8$ in the foregoing Formula 6. $R^{11}$ is an alkyl group having from 1 to 4 carbon atoms such as a methyl group, an ethyl group, a propyl group and a butyl group, or a trialkylsilyl group; and r is an integer of from 1 to 4.

Concrete examples of preferable oxetane compound to be used in the invention include the following compounds.

Exemplified compound 4

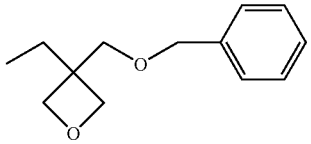

Exemplified compound 5

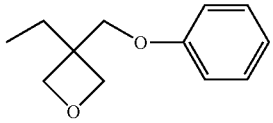

Exemplified compound 6

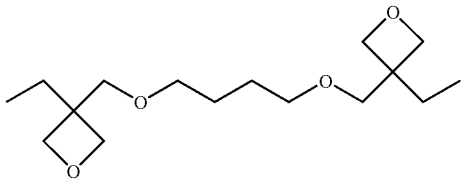

The above-mentioned compounds each having the oxetane ring can be produced by known methods without any limitation, for example, the oxetane ring synthesizing method from diol disclosed by D. B. Pattison, J. Am. Chem. Soc., 3455, 97 (1957). Other than the above-mentioned, a compound having 1 to 4 oxetane rings and a molecular weight of from 1,000 to 5,000 is usable. Concrete examples of such the compound are as follows.

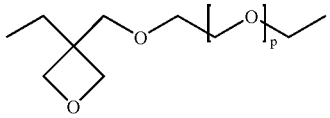

p: 20~200

-continued

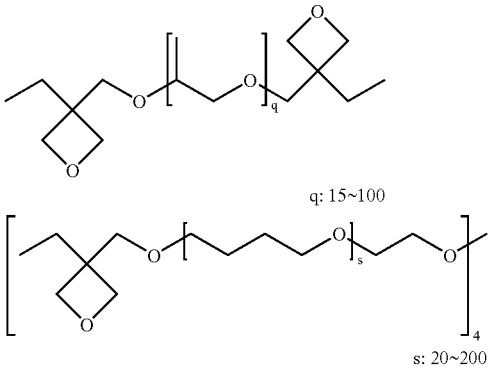

Employed as photopolymerizable compounds according to the present invention may be any of the radically polymerizable or cationically polymerizable compounds described above. Of these, preferred are compounds which result in minimal variation of curing rates even though the exposure intensity (mW) of ultraviolet radiation varies, or namely, compounds which exhibit minimal reciprocity failure. From the viewpoint of the foregoing, cationically polymerizable compounds are more preferable than radically polymerizable compounds, which need to be subjected to polymerization inhibition due the presence of oxygen.

In the present invention, it is preferable that at least one of photopolymerization initiators and photolytically acid generating agents is incorporated into the ink.

In the present invention, in order to efficiently carry out the curing reaction of a photocurable ink, it is preferable that curing is carried out in the presence of photopolymerization initiators known in the art. The aforesaid photopolymerization initiators are divided mainly into two types, i.e., an intramolecular bond cleavage type and an intramolecular hydrogen extraction type.

Examples of intramolecular bond cleavage type photopolymerization initiators include acetophenone based compounds such as diethoxyacetophenone, 2-hydroxy-2-methyl-1-phenylpropane-1-one, benzyl dimethyl ketal, 1-(4-isopropylphenyl)-2-hydroxy-2-methylpropane-1-one, 4-(2-hydroxyethoxy)phenyl-(2-hydroxy-2-propyl)ketone, 1-hydroxycyclohexyl-phenyl ketone, 2-methyl-2-morpholino(4-thiomethylphenyl)propane-1-one, 2-benzyl-2-dimethylamino-1-(4-morpholinophenyl)-butane; benzoins such as benzoin, benzoin methyl ether, and benzoin isopropyl ether; acylphosphine oxide based compounds such as 2,4,6-trimethylbenzoindiphenylphosphine oxide; and benzyl and methylphenylglyoxy ester.

On the other hand, examples of intramolecular hydrogen extraction type photopolymerization initiators include benzophenone based compounds such as benzophenone, o-benzoylbenzoic acid methyl-4-pnenylbenzophenone, 4,4'-dichlorobenzophenone, hydroxybenzophenone, 4-benzoyl-4'-methyl-diphenyl sulfide, acrylated benzophenone, 3,3',4,4'-terta(t-butylperoxycarbonyl)benzophenone, and 3,3'-dimethyl-4-methoxybenzophenone; thioxanthone based compounds such as 2-isopropylthixanthone, 2,4-dimethylthioxanthone, 2,4-diethylthioxanthone, and 2,4-dichloroxanthone; aminobenzophenone based compounds such as Michler's ketone and 4,4'-diethylaminobenzophenone; and 10-butyl-2-chloroacrydone, 2-ethylanthraquinone, 9,10-phenanthlenequinone, and camphorquinone.

The blending amount of photopolymerization initiators is preferably in the range of 0.01–10.00 percent by weight in the photocurable ink composition.

As a photo cation initiator, for example, a compound applied in a chemical amplitude type photoresist or photo cation polymerization can be used, cf. "Organic materials for Imaging", ed. Organic electronics material Kenkyuu-Kai, p.p. 187–192, Bunshin Syuppan, 1993. Examples of the compound suitable for the invention are shown below.

Firstly, a salt of $B(C_6F_5)_4^-$, $PF_6^-$, $AsF_6^-$, $SbF_6^-$ or $CF_3SO_3^-$ with an aromatic onium compound such as diazonium, ammonium, iodonium, sulfonium and phosphonium can be cited.

Concrete examples of the onium compound usable in the invention are shown below.

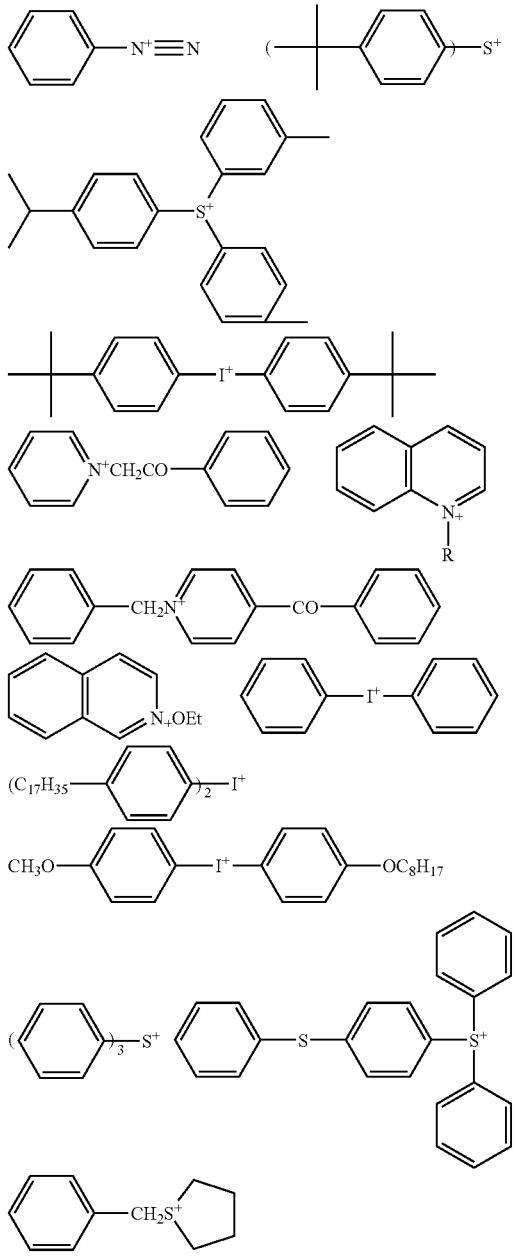

-continued
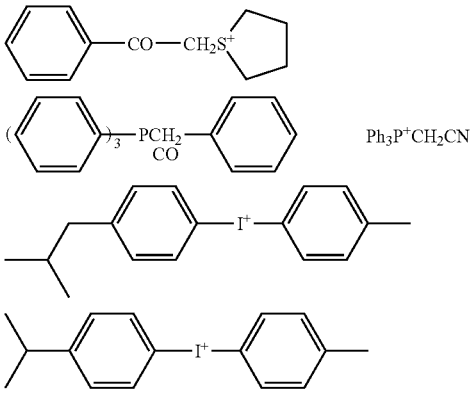
Secondary, a sulfone compound capable of generating a sulfonic acid can be cited; the concrete compounds are shown below.
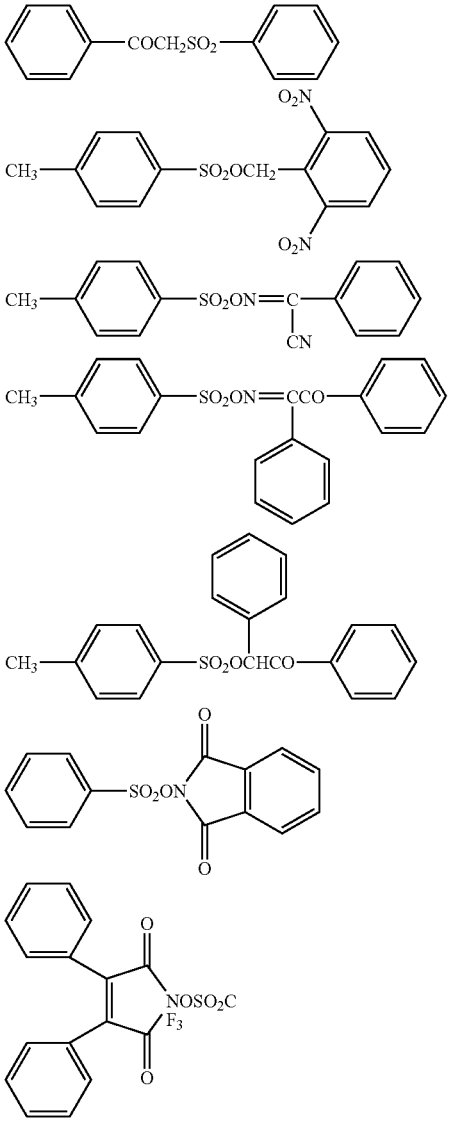
-continued
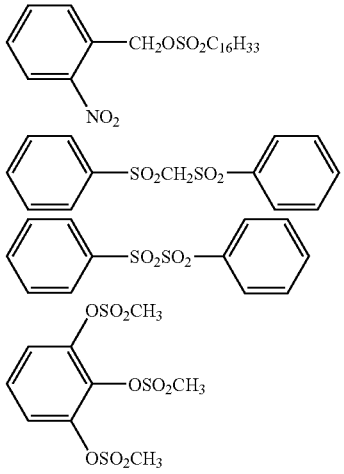
Thirdly, a halogen compound capable of generating a hydrogen halide can also be used; the concrete compounds are shown below.
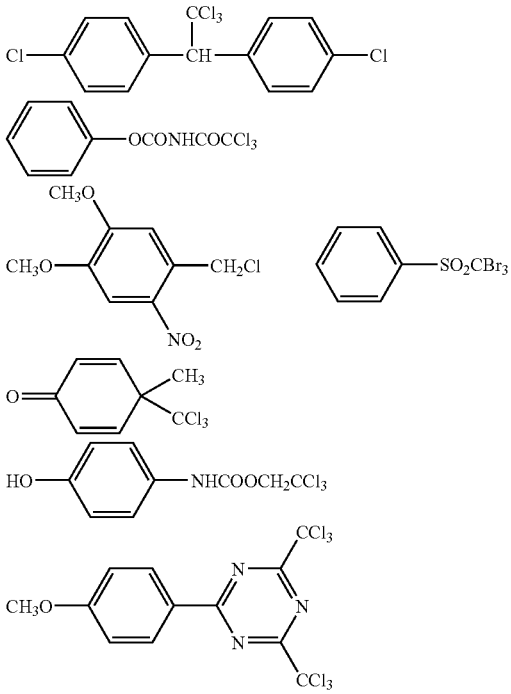
Fourthly, an iron-allene complex can be cited.
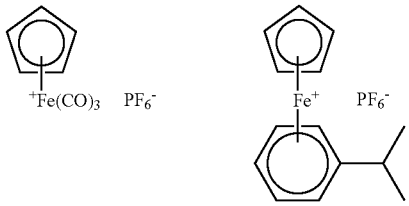

Further, the actinic radiation curable composition of the present invention is cured by exposure to actinic radiation such as ultraviolet radiation. In order to more efficiently conduct such curing reaction, it is possible to simultaneously use photosensitizers. Examples of such photosensitizers include amines such as triethanolamine, methyldiethanolamine, triisopropanolamine, methyl 4-dimethylaminobenzoate, isoamyl 4-dimethlaminobenzoate, ethyl 2-diethylaminobenzoate, n-butoxyethyl 4-dimethylaminobenzoate, and 2-ethylhexyl 4-dimethylaminobenzoate, cyanine, phthalocyanine, merocyanine, porphyrin, spiro compounds, ferrocene, fluorene, flugide, imidazole, perylene, phenazine, phenothiazine, polyene, azo compounds, diphenylmethane, triphenylmethane, polymethine acridine, coumarin, ketocoumarin, quinacridone, indigo, styryl, pyrylium compounds, pyrromethene compounds, pyrazolotriazole compounds, benzothiazole compounds, barbituric acid derivatives, and thiobarbituric acid derivatives. Further, employed are compounds described in European Patent No. 568,993, U.S. Pat. Nos. 4,508,811 and 5,227,227, and Japanese Patent Application Open to Public Inspection Nos. 2001-125255 and 11-271969. The used amount of photosensitizers is preferably in the range of 0.01–10.00 percent by weight in the actinic radiation curable composition.

In order to improve various kinds of performance, it is also possible to add materials such as coloring agents (colorants), silane coupling agents, polymerization inhibitors, and leveling agents to the actinic radiation curable composition of the present invention in amounts in which original characteristics are not degraded.

As the colorants in the present invention are, the colorants, which can be solved or dispersed in main component of the polymeric compound, can be used, however, from the viewpoint of weather fastness, the pigment is preferable.

As the pigment, the followings can be used.

C.I. Pigment Yellow-1, 3, 12, 13, 14, 17, 81, 83, 87, 95, 109, 42,

C. I. Pigment Orange-16, 36, 38,

C. I. Pigment Red-5, 22, 38, 48:1, 48:2, 48:4, 49:1, 53:1, 57:1, 63:1, 144, 146, 185, 101, C. I. Pigment Violet-19, 23, C. I. Pigment Blue-15:1, 15:3, 15:4, 18, 60, 27, 29, C. I. Pigment Green-7, 36

C. I. Pigment White-6, 18, 21,

C. I. Pigment Black-7.

Further, in the present invention, in order to enhance covering power of color on transparent substrates such as plastic film, it is preferable to use a white ink. Specifically, in soft package printing and label printing, it is preferable to use a white ink. However, since the ejection amount increases, from the viewpoint of the aforesaid ejection stability, and the formation of curling and wrinkling, the amount to be used is obviously limited.

To disperse the pigment, a ball mill, sand mill, attritor, roll mill, agitator, Henschel mixer, colloid mill, ultrasonic homogenizer, Pearl mill, wet jet mill, or paint shaker may be used. Further, when the pigment is dispersed, the dispersing agent can also be added. It is preferable that, as the dispersing agent, high polymeric dispersing agent is used. As the high polymeric dispersing agent, Solsperse series of Avecia co., is cited.

Further, as the dispersion auxiliary agent, the synergist corresponding to each kind of pigment can also be used. It is preferable that 1–50 parts by weight of these dispersing agent and dispersion auxiliary agent are added to 100 parts by weight of the pigment. The dispersion medium is solvent or polymeric compound, and it is preferable that the ultraviolet ray-curable ink used in the present invention comprises no-solvent, because it is reacted and hardened just after the arrival of the ink. When the solvent remains in the hardened image, the problem of deterioration of solvent resistance and VOC (Volatile Organic Compound) of the remained solvent is raised. Accordingly, it is preferable in the dispersion aptitude that the dispersion medium is not solvent, but polymeric compounds, and the monomer in which the viscosity is lowest in them, is selected.

When the dispersion is conducted, it is preferable to configure the pigment, dispersing agent, selection of diluent for the dispersion so that average particle size of the pigment become 0.08–0.5 μm, more preferably 0.3–10 μm, still more preferably, 0.3–3 μm. By this particle size control, the nozzle plugging of the ink-jet head is suppressed, and the preservation stability of the ink, ink transparency and hardening sensitivity can be maintained.

It is preferable for the colorant that the addition amount is 1 weight % to 10 weight % of the whole of the ink.

Listed as silane coupling agents are, for example, γ-methacryloxypropyltrimethoxysilane, γ-(2-aminoethyl)aminopropyltrimethoxysilane, and γ-mercaptopropyltrimethoxysilane.

Listed as polymerization inhibitors are, for example, methoquinone, methylhydroquinone, and benzoquinone. Further, listed as leveling agents are, for example, Modaflo (manufactured by Monsanto Co.) and FC-430 (manufactured by 3M Co.).

It is preferable for these additives that the addition amount is more than 0 to 20 weight % of the whole of the ink composition.

The ultraviolet radiation curable ink jet ink composition according to the present invention may be prepared by mixing the components described above, and the mixing order and methods are not particularly limited.

The actinic radiation curable ink jet ink composition prepared as above is preferably employed which exhibits a viscosity of 5–30 mPa·s at 50° C. as a physical characteristic. Further, in order to enable ink droplets to be stably deposited onto ink images differing in history of exposure to ultraviolet radiation, the surface tension of liquid ink compositions is preferably 28–40 mN/m, and is more preferably 30–36 mN/m.

Further, if desired, it is possible to incorporate solvents into the actinic radiation curable ink jet ink composition of the present invention. Examples of such solvents include ketones such as methyl ethyl ketone or methyl isobutyl ketone, acetic acid esters such as ethyl acetate or butyl acetate, aromatic hydrocarbons such as benzene, toluene, or xylene, alcohols such as ethylene glycol monoacetate or propylene glycol dimethyl ether, and water, as well as commonly employed organic solvents. It is possible to use these to dilute the actinic radiation curable compositions of the present invention.

In the ink jet recording method of the present invention, various conditions, except for the items already described above, will now be described.

In the ink jet recording method of the present invention, the aforesaid ink composition is ejected onto recording materials, employing the ink jet recording apparatus of the present invention to form images, and subsequently, ink is cured by exposure to actinic radiation such as ultraviolet radiation.

In the present invention, it is preferable that after inks are deposited onto recording materials and cured by exposure to actinic radiation, the resulting total ink layer thickness is 2–20 μm. In actinic radiation curable ink jet recording in the screen printing field, currently, the total ink layer thickness exceeds 20 μm. However, in the flexible package printing field in which thin plastic materials are used as a recording material, in addition of problems of curling and wrinkling of recording materials as described above, problems occur in which stiffness and the feel of quality of the entire printed matter vary. Subsequently, ink ejection which results in an excessive high layer thickness is not preferred.

The total ink layer thickness is a thickness of a maximum thickness of total ink on a recording medium, which includes a thickness of an ink or a plurality of inks, such as two, three or four inks.

Preferred ink ejection conditions are such that, as noted above, the recording head as well as the ink is heated to 35–100° C. to stabilize ejection. An actinic radiation curable ink exhibits a wide range of viscosity variation due to temperature variation. The resulting viscosity variation largely and directly affects the size of liquid droplets as well as the liquid ejection rate, leading to degradation of image quality. Therefore, it is required that the temperature of ink is kept constant after raising the temperature. As noted above, the control range of the ink temperature is the commonly specified temperature ±5° C., is preferably the specified temperature ±2° C., and is more preferably the specified temperature ±1° C.

In the present invention, in order to reduce the tactile roughness of images after printing, from the viewpoint of appropriately achieving leveling and minimizing bleeding between colors, it is preferable that the size of liquid droplets ejected from each nozzle is small. The minimum size of liquid droplets is preferably at most 20 pl, and is more preferably at most 7 pl. However, a size of less than one pl is not preferred because linear movement of liquid droplets is degraded, resulting in a decrease in deposition accuracy or the nozzle surface is stained due to ink misting.

In the ink jet recording method of the present invention, exposure conditions of actinic radiations are such that after deposition of ink droplets onto recording materials, actinic radiation is preferably exposed over a period of 0.01–2.0 seconds and is more preferably exposed over a period of 0.1–1.0 second. When the duration prior to exposure is less than 0.1 second, it is extremely difficult to achieve sufficient leveling effects. On the other hand, when it is 2.0 seconds or more, bleeding problems occur.

Recording materials which may be employed in the ink jet recording method and/or the ink jet recording apparatus of the present invention are not particularly limited.

In the present invention, it is possible to employ various components in substrate 2 which result in recording media. When recording media are comprised of resins, various resinous films such as PET film, OPS film, OPP film, ONy film, PVC film, PE film, or TAC film are specifically employed. Other than these, employed as resins may be polycarbonates, acryl resins, ABS, plyacetals, PVA, and various kinds of rubber. In addition, employed may be fine-quality paper, matte paper, coated paper, art paper, printing paper, metals and glass.

Heretofore, since the surface energy of various these substrates differs markedly, problems have been pointed out in which dot diameter varies after ink deposition depending on materials. However, by employing the aforesaid ink, it is possible to form highly detailed images on a wide range of materials of a surface energy range of 35–60 mJ/m$^2$, including OPP film as well as OPS film of a low surface energy to PET film of a relatively high surface energy.

EXAMPLES

Specific aspects of the present invention will now be described with reference to examples.

<<Preparation of Ink>>

Each colored ink comprised of the composition described in Table 1 was prepared.

During preparation of each colored ink, 15 percent by weight of Solsperse 2400, manufactured by Avecia, as a pigment dispersing agent was added and the resulting mixture was dispersed employing a sand mill. Thereafter, initiators were added and filtered employing a 0.8 μm membrane filter.

TABLE 1

| | Ink Composition (weight %) | | | | | |
|---|---|---|---|---|---|---|
| | | | Photopolymerizable Compound | | | |
| | Colorant | | Epoxy Compound | Oxetane Compound | | |
| Ink | | Added | Celoxide | | | Initiator |
| Type | Type | Amount | 2021P | OXT-221 | OXT-212 | SP152 |
| K | Colorant 1 | 5.0 | 15.0 | 40.0 | 35.0 | 5.0 |
| C | Colorant 2 | 2.5 | 17.5 | 45.0 | 30.0 | 5.0 |
| M | Colorant 3 | 3.0 | 17.0 | 45.0 | 30.0 | 5.0 |
| Y | Colorant 4 | 2.5 | 17.5 | 45.0 | 30.0 | 5.0 |

Each abbreviation described in Table 1 is detailed as follows.

K: concentrated black ink
C: concentrated cyan ink
M: concentrated magenta ink
Y: concentrated yellow ink
Colorant 1: C.I. Pigment Black-7
Colorant 2: C.I. Pigment Blue-15: 3
Colorant 3: C.I. Pigment Red-122
Colorant 4: C.I. Pigment Yellow-74
Epoxy Compound: Celoxide 2021P, manufactured by Daicel Chemical Industries, Ltd.
Oxetane Compound: OXT-212, manufactured by TOAGOSEI Chemical Industry Co., Ltd.
Oxetane Compound: OXT-221, manufactured by TOAGOSEI Chemical Industry Co., Ltd.
Initiator: SP152, manufactured by Adeka Co.

<<Ink Jet Recording Apparatus>>

A serial printing system ink jet printer, constituted as shown in FIG. 1, was employed. Four colored inks prepared as above were charged into the carriage and ultraviolet radiation exposure lamps were arranged at both ends of the aforesaid carriage.

Employed as ink jet nozzles was a piezoelectric head of a nozzle pitch of 360 dpi capable of varying liquid droplet size in the range of 4–28 pl. At 360 dpi, employed was a liquid droplet size of 4–28 pl per pixel, while at 720 dpi, employed was a liquid droplet size of 4–8 pl. Incidentally, dpi, as described in the present invention, refers to the number of dots per inch or 2.54 cm.

Employed as ultraviolet lamps arranged at both ends of the carriage were mercury lamps, having a major peak at 365 nm, and exposure intensity (mW) was regulated by appropriately controlling electrical power.

Further, employed as recording materials was fine-quality paper. Solid Y, M, C, and K images, images in which textual images of different point and reverse-text were printed in 4-colored solid patches, and wedge images were outputted.

<<Image Formation>>

Each of the above images was formed based on the image forming methods described below.

TABLE 2

| Image Forming Method | Resolution (dpi) | Printing Method | Interleave | Pass Frequency | Carriage Speed (mm/cm) | Relative Image Recording Speed | Relative Exposure Intensity | Remarks |
|---|---|---|---|---|---|---|---|---|
| 1 | 360 | two-way | 2 | 2 | 200 | 100 | 100 | Inv. |
| 2 | 360 | two-way | 3 | 3 | 200 | 67 | 67 | Inv. |
| 3 | 720 | one-way | 2 | 8 | 200 | 25 | 25 | Inv. |
| 4 | 720 | two-way | 2 | 4 | 200 | 50 | 50 | Inv. |

Inv.; Present Invention

In the aforesaid Image Forming Methods 1–4, ultraviolet exposure energy per unit area was constant.

TABLE 3

| Image Forming Method | Resolution (dpi) | Printing Method | Interleave | Pass Frequency | Carriage Speed (mm/cm) | Relative Image Recording Speed | Relative Exposure Intensity | Remarks |
|---|---|---|---|---|---|---|---|---|
| 5 | 360 | two-way | 3 | 3 | 200 | 67 | 100 | Inv. |
| 6 | 720 | one-way | 2 | 8 | 200 | 25 | 100 | Comp. |
| 7 | 720 | two-way | 2 | 4 | 200 | 50 | 100 | Inv. |

Inv.; Present Invention
Comp.; Comparative Example

In aforesaid Image Forming Methods 5–7, the relative exposure intensity of ultraviolet radiation was regulated to be the same as in Image Forming Method 1. As a result, the resulting relative image recording speed decreased and the amount of total ultraviolet radiation exposure energy in all Image Forming Methods 5–7 increased. When the amount of ultraviolet radiation exposure energy of Image Forming Method 1, which was used as a standard, was 100, the amount of energy of the same for Image Recording Methods 5–7 was 150, 400, and 200, respectively.

TABLE 4

| Image Forming Method | Resolution (dpi) | Printing Method | Interleave | Pass Frequency | Carriage Speed (mm/cm) | Relative Image Recording Speed | Relative Exposure Intensity | Remarks |
|---|---|---|---|---|---|---|---|---|
| 8 | 360 | two-way | 2 | 2 | 600 | 300 | 100 | Comp. |
| 9 | 360 | two-way | 3 | 3 | 600 | 200 | 100 | Inv. |
| 10 | 720 | one-way | 2 | 8 | 600 | 75 | 100 | Inv. |
| 11 | 720 | two-way | 2 | 4 | 600 | 150 | 100 | Inv. |

Comp.; Comparative Example
Inv.; Present Invention

In above Image Forming Methods 8–11, carriage speed was tripled compared to aforesaid Image Forming Methods 1–4 and relative exposure intensity of ultraviolet radiation was set to be the same as aforesaid Image Forming Method 1. When the amount of ultraviolet radiation exposure energy of Image Forming Method 1, which was used as a standard, was 100, the amount of energy of Image Recording Methods 8–11 was 33, 50, 133, and 67, respectively.

<<Evaluation of Images>>

Each image prepared as above was subjected to each of the evaluations described below.

(Evaluation of Tactile Roughness)

The roughness state of each solid image prepared as above was visually observed, and the tactile roughness was evaluated based on the criteria described below.

A: no roughness of ink droplets was noticed on images and the surface was smooth B: slight roughness of ink droplets was noticed on images, resulting in a slight decrease in smoothness, but the roughness was in the range of commercial viability C: roughness of ink droplets was clearly noticed, resulting in degradation of smoothness and the overall quality resulted in problems for commercial viability (Determination of Glossiness)

Glossiness of solid each color image was determined based on the method (60-degree specular gloss or Gs 60 degrees, specified in JIS Z 8741) and average values were calculated. Evaluation was carried out based on the criteria described below.

A: average glossiness of four-color solid image portions (YMCK) was at least 80 percent B: average glossiness of four-colored image portions (YMCK) Was 50–80 percent C: average glossiness of four-color solid image portions (YMCK) was less than 50 percent (Determination of Image Density)

Reflection density of each color of the solid color images was determined employing a reflection densitometer (manufactured by X-Rite Corp.), and the average value of each color was calculated. Evaluation was carried out based on the criteria described below.

A: the average value of solid image density of each color was at least 1.5

B: the average value of solid image density of each color was between 1.0–1.5

C: the average value of solid image density of each color was less than 1.0

(Evaluation of Bleeding Resistance)

Images which were formed by printing reverse-text of varying points in four-color solid patches prepared as above as well as wedge images were visually observed, and bleeding resistance was evaluated based on the criteria described below.

A: no bleeding was noticed in the reverse-text nor in the wedge image

B: no bleeding was noticed in the reverse-text, but bleeding was locally noticed in the wedge image C: bleeding was clearly noticed in both the reverse-text and the wedge image Table 5 shows the above results.

TABLE 5

| | | Each Evaluation Result | | | | |
|---|---|---|---|---|---|---|
| Image No. | Image Forming Method | Tactile Roughness | Glossiness | Image Density | Bleeding Resistance | Remarks |
| 1 | 1 | A | A | A | A | Inv. |
| 2 | 2 | A | A | A | A | Inv. |
| 3 | 3 | A | A | A | A | Inv. |
| 4 | 4 | A | A | A | A | Inv. |
| 5 | 5 | A | A | A | A | Inv. |
| 6 | 6 | C | C | C | A | Comp. |
| 7 | 7 | B | B | B | A | Inv. |
| 8 | 8 | A | A | A | C | Comp. |
| 9 | 9 | A | A | A | B | Inv. |
| 10 | 10 | A | A | A | A | Inv. |
| 11 | 11 | A | A | A | A | Inv. |

Inv.; Present Invention
Comp.; Comparative Example

As can clearly be seen from Table 5, images which were formed according to the ink jet recording system of the present invention resulted in minimal tactile roughness of formed images, and exhibited excellent glossiness, image density, and bleeding resistance.

According to the present invention, it is possible to provide an ink jet recording apparatus and an ink jet recording method which are capable of stably forming images which exhibit excellent bleeding resistance, a feel of gloss and color reproduction, even though images are formed employing a plurality of recording modes which differ in image recording speed.

The invention claimed is:

1. An ink jet recording apparatus which comprises:

a section which forms an ink image by ejecting an ultraviolet radiation curable ink from an ink jet recording head onto a recording material;

a section which exposes ultraviolet radiation to the ink image formed on the recording material;

wherein the ink jet recording apparatus has a plurality of recording modes each having a different image recording speed in each mode, the ink jet recording apparatus using an interleave image forming method such that the ink image is composed of jetted ink that has been exposed to ultraviolet radiation multiple times, an exposure intensity of ultraviolet radiation exposing to the ink is variable; and a control section which varies an exposure intensity of ultraviolet radiation per unit area depending on the number of times that the jetted ink is exposed.

2. The ink jet recording apparatus of claim 1, wherein the image recording speed is varied by (a) varying the relative speed of an ink jet nozzle with respect to the recording material, (b) varying recording resolution, or (c) varying pass frequency of the interleave system.

3. The ink jet recording apparatus of claim 1, wherein the exposure intensity of ultraviolet radiation is varied by varying the exposure area of ultraviolet radiation or varying an illumination intensity of ultraviolet radiation.

4. The ink jet recording apparatus of claim 1, wherein the exposure intensity of ultraviolet radiation exposing to the ink is varied corresponding to the image recording speed.

5. An ink jet recording method which forms an ink image by ejecting an ultraviolet radiation curable ink from an ink jet recording head onto a recording material and subsequently exposing ultraviolet radiation to the ink image, wherein the ink jet recording method comprises a plurality of recording modes having a different image recording speed in each mode, the ink image is formed by an interleave image forming method in which the ink image is composed of jetted ink that has been exposed to ultraviolet radiation multiple times, an exposure intensity of ultraviolet radiation exposing to the ink is variable, varying the exposure intensity of ultraviolet radiation per unit area depending on the number of times that the jetted ink is exposed.

6. The ink jet recording method of claim 5, wherein the image recording speed is varied by (a) varying the relative speed of an ink jet nozzle with respect to the recording material, (b) varying recording resolution, or (c) varying pass frequency of the interleave system.

7. The ink jet recording method of claim 5, wherein the exposure intensity of ultraviolet radiation is varied by varying the exposure area of ultraviolet radiation or varying the illumination intensity of ultraviolet radiation.

8. An ink jet recording apparatus which comprises:

a section which forms an ink image by ejecting an ultraviolet radiation curable ink from an ink jet recording head onto a recording material;

a section which exposes ultraviolet radiation to the ink image formed on the recording material;

wherein the ink jet recording apparatus has a plurality of recording modes each having a different image recording speed by varying pass frequency employing an interleave system in each mode such that the ink image is composed of jetted ink that has been exposed to ultraviolet radiation multiple times, an exposure intensity of ultraviolet radiation exposing to the ink is variable; and a control section which varies an exposure intensity of ultraviolet radiation per unit area depending on the number of times that the jetted ink is exposed, and maintains nearly a constant amount of energy per unit area independent of the image recording speed by varying a pass frequency of the interleave system.

9. An ink jet recording method which forms an ink image by ejecting an ultraviolet radiation curable ink from an ink jet recording head onto a recording material and subsequently exposing ultraviolet radiation to the ink image, wherein the ink jet recording method comprises a plurality of recording modes having a different image recording speed caused by varying pass frequency employing an interleave system in each mode such that the ink image is composed of jetted ink that has been exposed to ultraviolet radiation multiple times, varying an exposure intensity of ultraviolet radiation exposed to the ink, and varying an exposure intensity of ultraviolet radiation per unit area depending on the number of times that the jetted ink is exposed, and maintaining nearly a constant amount of energy per unit area independent of the image recording speed by varying a pass frequency of the interleave system.

* * * * *